US007392552B2

(12) United States Patent
Lu

(10) Patent No.: US 7,392,552 B2
(45) Date of Patent: Jul. 1, 2008

(54) LIGHT-EFFECT MODULE FOR FAUCET

(75) Inventor: Ching-Hsien Lu, 8F., No. 66, Lane 57, Jian Cheng Rd., Xizhi City, Taipei Hsien (TW)

(73) Assignees: Su-Lan Wu, Taipei Hsien (TW); Ching-Hsien Lu, Taipei Hsien (TW)

( * ) Notice: Subject to any disclaimer, the term of this patent is extended or adjusted under 35 U.S.C. 154(b) by 174 days.

(21) Appl. No.: 11/469,490

(22) Filed: Sep. 1, 2006

(65) Prior Publication Data

US 2008/0052820 A1 Mar. 6, 2008

(51) Int. Cl.
*E03D 1/04* (2006.01)

(52) U.S. Cl. ..... 4/675; 362/96

(58) Field of Classification Search ..... 4/661, 4/675–678

See application file for complete search history.

(56) References Cited

U.S. PATENT DOCUMENTS

| | | | | | |
|---|---|---|---|---|---|
| 3,845,291 | A * | 10/1974 | Portyrata | 362/192 |
| 4,616,298 | A * | 10/1986 | Bolson | 362/192 |
| 4,784,303 | A * | 11/1988 | Ahad et al. | 4/676 |
| 5,171,429 | A * | 12/1992 | Yasuo | 210/94 |
| 5,482,078 | A * | 1/1996 | Yeh | 137/551 |
| 6,126,290 | A * | 10/2000 | Veigel | 362/96 |
| 6,134,722 | A * | 10/2000 | Lowry et al. | 4/541.1 |
| 6,519,790 | B2 * | 2/2003 | Ko | 4/678 |
| 6,805,458 | B2 * | 10/2004 | Schindler et al. | 362/96 |
| 2005/0098485 | A1 * | 5/2005 | Boyd et al. | 210/87 |

* cited by examiner

*Primary Examiner*—Charles E Phillips
(74) *Attorney, Agent, or Firm*—Leong C. Lei

(57) ABSTRACT

A faucet light-effect module is disclosed. The device comprises a housing, a spring switch, an electro-magnetic control module. The device produces a different color water stream based on the temperature of the water detected by the module.

4 Claims, 4 Drawing Sheets

LIGHT-EFFECT MODULE FOR FAUCET

BACKGROUND OF THE INVENTION (a) Technical Field of the Invention

The present invention relates to light-effect module, and in particular, a light-effect module for mounting onto the water outlet of a faucet.

(b) Description of the Prior Art

Conventional faucets available in the market provide with only one function, i.e., to control the water flowrate from water pipes. In order to indicate the water flow temperature either hot or cold, two markers blue and red, are marked on the faucet for controlling hot and cold water flowrate. As these marks are not significant, users have no way to tell the temperature of the water from the water supply. Accordingly, it is an object of the present invention to provide a light-effect module for faucet which mitigates the above-mentioned drawback.

SUMMARY OF THE INVENTION

The primary purpose of the present invention is to provide a faucet light-effect module for mounting onto the water outlet of the faucet comprising a housing, a battery cover, an electro-magnet control module, a spring switch and a light-emitting device, characterized in that the housing includes an inner and an external wall forming into a cavity for holding batteries, and the water outlet of the housing is a loudspeaker shaped with slanting edge mounted with one or more than one same color or different colors light-emitting devices, the battery cover mounted onto a battery compartment of the module and is sealed with water resistant rubber rim, the electromagnetic control module covered by the housing including a paddling rod, a restoration rod, and a magnetic device, and the paddling rod is extended from the shaft center of the magnetic device and the front end of the paddling plate is inserted into the inner wall of the housing which is directly in contact with water stream and the paddling plate is rotated by the water stream which simultaneously drives the magnetic element to change is polarity, the restoration rod restores the polarity of the magnetic device when the water stream stops flowing; the spring switch is positioned at the outer of the housing covered the electromagnet control module and directly accepts with changes of the polarity and restoration effected by the magnetic device to form into the switch for the power supply; and the light-emitting element includes different color LED mounted at the slanting edge of the faucet.

Yet still another object of the present invention to provide a faucet light-effect module, wherein a flickering IC is used to provide light flickering effect.

Yet a further object of the present invention is to provide a light-effect module for faucet, wherein an electronic switch and a thermal sensitive resistance are mounted in the housing.

Still a further object of the present invention is to provide a light-effect module for faucet, wherein a thermal sensor IC is used to sense the temperature of the water.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
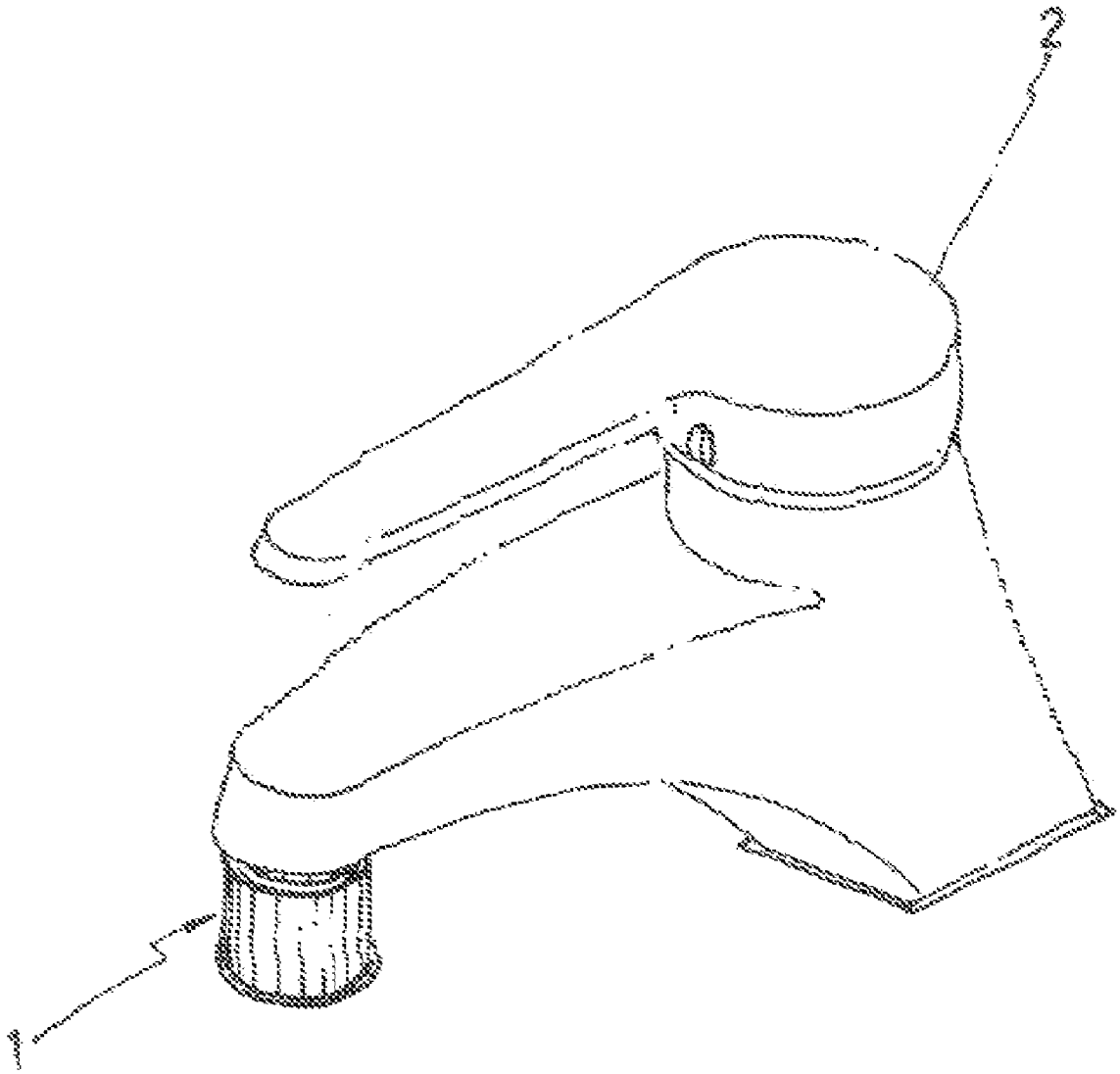
FIG. 1 is a perspective view showing the faucet light-effect device of the present invention mounted onto a faucet.

Referring to FIG. 1, there is shown a light-effect module for faucet which is mounted at the water outlet of a water tape 2 in accordance with the present invention.

Figure 2:
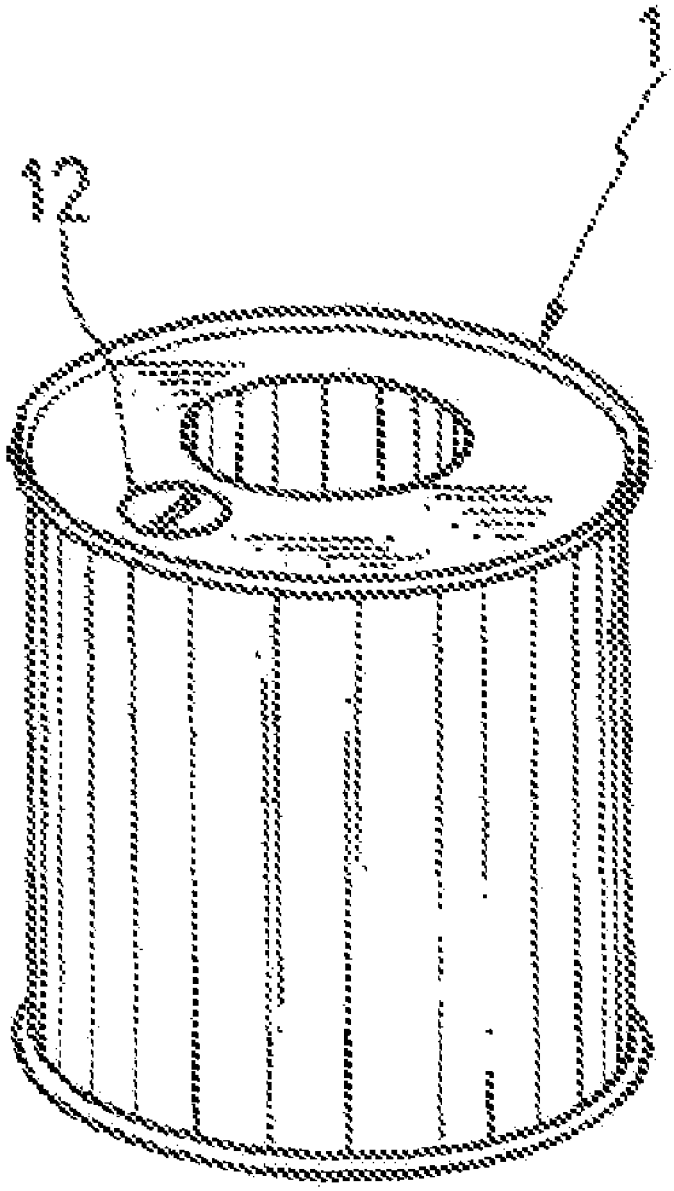
FIG. 2 is a perspective view of the faucet light-effect device of the present invention.
Figure 3:
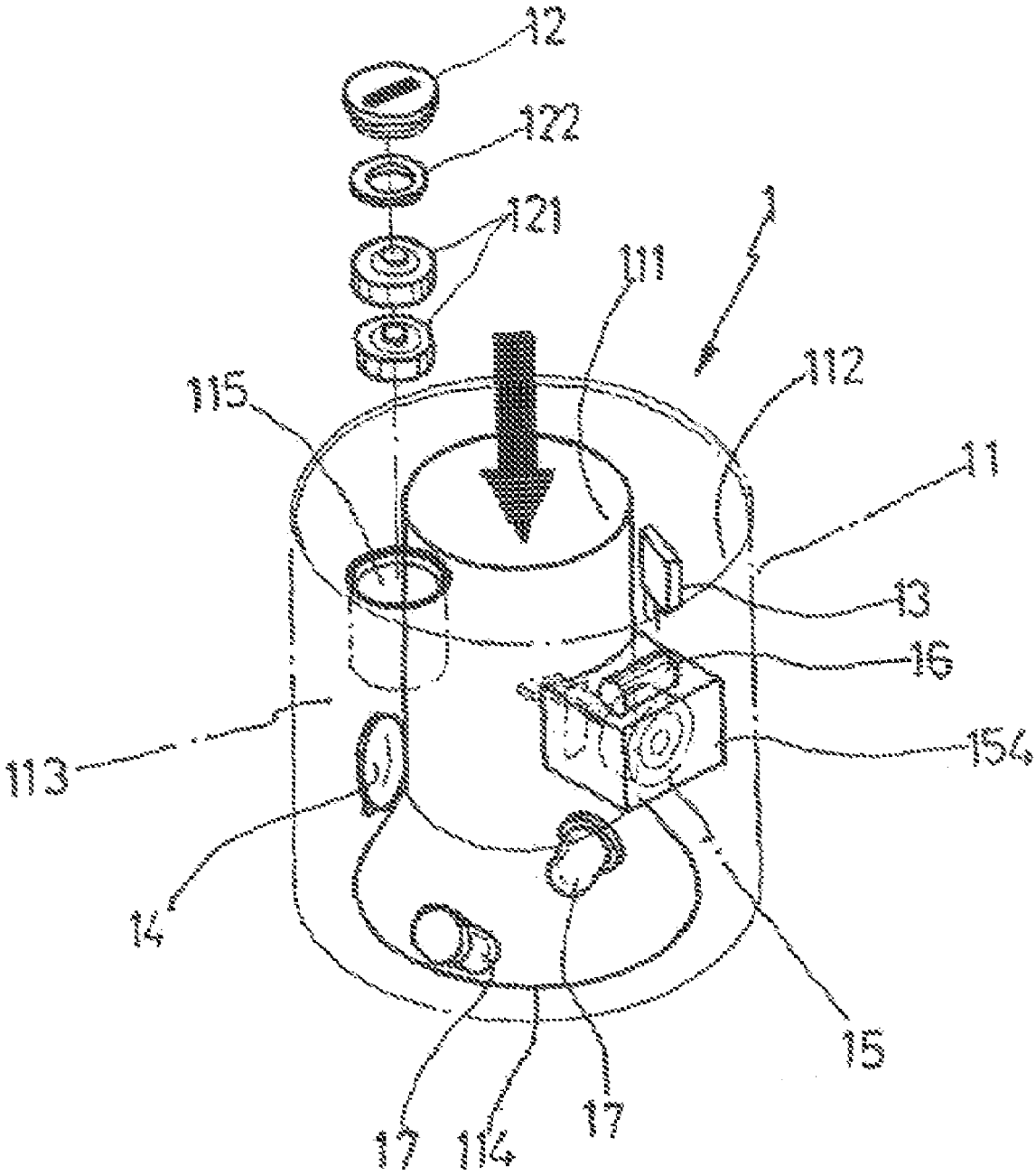
FIG. 3 is an exploded perspective view of the light-effect device of the present invention.

As shown in FIGS. 2 and 3, the light-effect module comprises a housing 11, a battery cover 12, an electronic switch 13, a thermal sensitive resistance 14, an electro magnetic control module 15, a spring switch 16 and one or more light-emitting elements 17. The housing 11 includes an inner and an external wall 111, 112, forming into a space or a cavity 113 for holding batteries 121, the electronic switch 13, the thermal sensitive resistance 14, the electromagnetic control module 15 and the spring switch 16. The water outlet end of the housing 1 is a loudspeaker shaped opening 114 and has a slanting edge for mounting with one or more than one light-emitting elements 17.

FIG. 3 shows a preferred embodiment of the light-effect module, wherein the light-emitting device is a LED, which can be of same color or of different colors. The LED 17 is mounted at the slanting edge of the opening end and provides a projection light onto the water stream.

The batteries 121 supply the power to the light-effect module. In accordance with the present invention, the battery power 12 is locked and a water resistant rubber pad 122 is mounted thereto such that after the battery cover is mounted onto the battery cavity 115, it is water proof.

Figure 4:
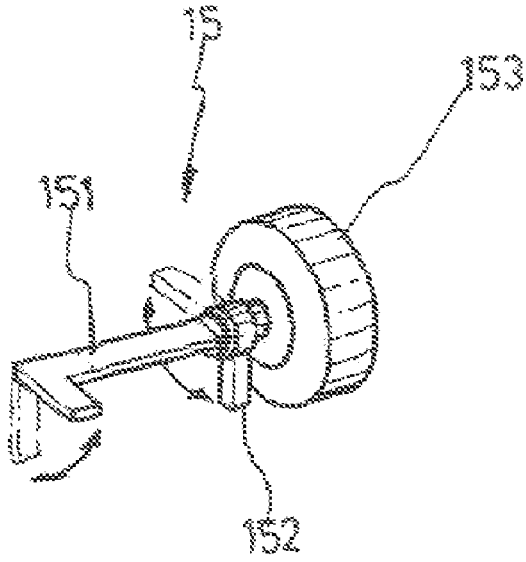
FIG. 4 is a perspective view of the electromagnet control module and the action thereof in accordance with the present invention.

As shown in FIG. 3, after the power supply is switched on, which is achieved by the electromagnetic control (module 15 and the spring switch 16. When the faucet 2 is turned on, the water flow drives the electromagnetic control module 15 and the polarity of the electromagnet of the module changes and the polarity of the spring switch 16 is also changed to switch on and off of the switch. As shown in FIG. 4, the electromagnetic control module 15 comprises a paddling rod 151, a restoration rod 152 and a magnetic element 153. The paddling rod 151 has a magnetic element 153 protruded into the inner wall 111 of the housing 1 and the paddling plate 1511 at the front end of the paddling rod 151 is directly contact with the water stream such that the paddling plate rotates. The paddling rod 151 rotates to drive the magnetic element 153 to change its polarity so as to turn the spring switch 16 to on position so that the current supply is provided to the mono color or multi colors light-emitting elements 17 to project a colored light onto the water stream.

Conversely, when the faucet 2 is turned off, there is no water flow and the paddling rod 151 makes use of the restoration rod 152 to restore the polarity of the magnetic element 153 and simultaneously drives the polarity of the spring switch 16 and the spring switch 16 is in off position. Thus, the current supply to the light-emitting device 17 is cut off.

Figure 5:
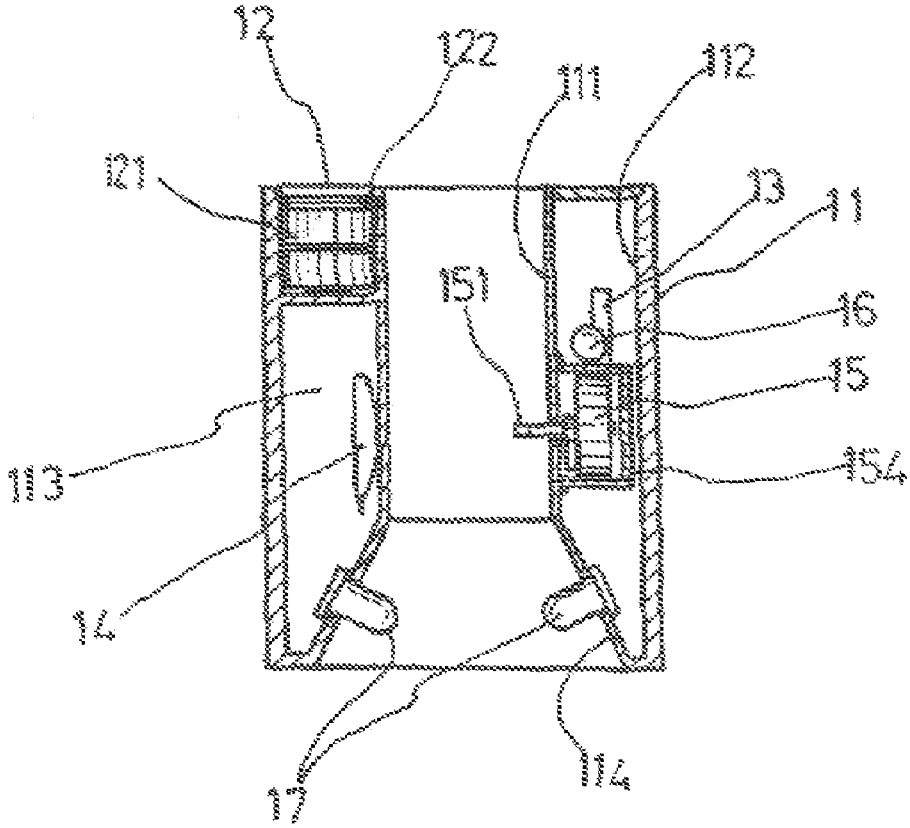
FIG. 5 is a sectional view of the faucet light-effect device of the present invention.

As shown in FIG. 5, for indication of water temperature of the water stream from the faucet 2. The light-effect module includes an electronic switch 13 and a thermal sensitive resistance 14. These two components can be substituted with a temperature sensor IC device. In accordance with the present invention, when the thermal sensitive resistance 14 has detected the external temperature, a high or low potential is shown and the electronic switch 13 generates two different colored light-emitting element 17 to indicate the temperature of the water. The color would be blue or red color.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A faucet light-effect module for mounting onto the water outlet of a faucet; comprising a housing, a battery cover, an electro-magnetic control module, a spring switch and a light-emitting device, characterized in that the housing includes an inner and an external wall forming a cavity area for holding batteries and a water passage area having a water outlet, said water outlet is loudspeaker shaped with a slanting edge mounted with at least one light-emitting device, said battery cover being mounted onto a battery compartment of the module and is sealed with water resistant rubber rim, the electro-magnetic control module being mounted in said cavity, said module including a paddling rod, a restoration rod, and a magnetic device, wherein the paddling rod is extended from a center shaft of the magnetic device and a front end of the paddling plate is positioned in said water passage area which is directly in contact with a water stream, whereby the paddling plate is rotated by the water stream which simultaneously drives the magnet element to change its' polarity, the restoration rod restores the polarity of the magnetic device when the water stream stops flowing: said spring switch is positioned in said cavity and directly accepts changes of the polarity and restoration effected by the magnetic device to form a switch supply of power from said battery.

2. The faucet light-effect module of claim 1, wherein a flickering IC is used to provide light flickering effect.

3. The faucet light-effect module of claim 1, wherein an electronic switch and a thermal sensitive resistance are mounted in the housing.

4. The faucet light-effect module of claim 3, wherein a thermal sensor IC is used to sense the temperature of the water.

* * * * *